United States Patent [19]

Westlund et al.

[11] 4,136,306

[45] Jan. 23, 1979

[54] APPARATUS FOR PREPARING PATTERN CONTROL TAPES

[75] Inventors: Kenneth P. Westlund, Danvers; Patrick N. Kirwan, Beverly, both of Mass.

[73] Assignee: USM Corporation, Farmington, Conn.

[21] Appl. No.: 815,369

[22] Filed: Jul. 13, 1977

Related U.S. Application Data

[63] Continuation of Ser. No. 610,774, Sep. 5, 1975, abandoned.

[51] Int. Cl.[2] ..... G05B 19/42

[52] U.S. Cl. ..... 318/568; 346/31; 178/18

[58] Field of Search ..... 318/568, 576, 577, 628; 346/31, 33, 34; 178/18, 19, 20; 235/151.11

[56] References Cited

U.S. PATENT DOCUMENTS

| | | | |
|---|---|---|---|
| 3,473,157 | 10/1969 | Little et al. | 318/568 X |
| 3,761,877 | 9/1973 | Fernald | 178/19 X |
| 3,873,769 | 3/1975 | Cotter | 178/18 |
| 3,936,712 | 2/1976 | Gerber et al. | 318/568 |

*Primary Examiner*—Herman J. Hohauser

*Attorney, Agent, or Firm*—William F. White; Richard B. Megley; Vincent A. White

[57] ABSTRACT

Apparatus is provided for digitizing a pattern by utilizing the computer controller and motor driver of an x-y table used in an automatic sewing machine. A manually operated control stick is installed on the machine and connected through the controller to send command signals to the motor drivers. A viewer is mounted on the machine to project a pattern, which is placed on the work surface of the x-y table, onto a small screen. The operator may then, through the use of the viewer and the control stick, move the x-y table through the desired pattern. Such movement is recorded in the computer for use in generating a control tape for the specific pattern.

2 Claims, 4 Drawing Figures

APPARATUS FOR PREPARING PATTERN CONTROL TAPES

This is a continuation, of application Ser. No. 610,774, filed 9-5-75, now abandoned.

BACKGROUND OF THE INVENTION

A recent innovation in the art of industrial stitching is the automatically controlled sewing machine in which the workpiece is mounted on a movable table which is driven by computer controlled motors. The workpiece is moved through a predetermined pattern under the sewing head. Generally the computer is controlled by magnetic tapes which contain information relating to the desired pattern to be stitched. This information is in coded or digitized form and contains the coordinate location of each stitch.

The magnetic tape is recorded on a system separate from the automatic sewing machine. This system consists of a tracing table operatively connected through encoders to a computerized magnetic tape recorder. A pattern is placed on the tracing table and a tracing tool is manually moved through the pattern. The tracing tool is mounted for movement along both x and y orthogonal axes and encoders are constructed to generate signals relative to the coordinate location of each stitch of the pattern. In this manner a control tape may be generated for each pattern.

It is the purpose of this invention to provide a method and apparatus for preparing the control tapes directly on the automatically controlled sewing machine, in order to remove the necessity for the separate system and increase the efficiency of the overall machine. This is accomplished by mounting a digitizing kit on the automatic sewing machine and feeding the signals derived therefrom to the computer controller.

SUMMARY OF THE INVENTION

An optical viewer is mounted on an automatic sewing machine adjacent to the x-y table. This viewer is used to scan a pattern which is placed on the x-y table. A manually operated joystick is also mounted on the machine for operation in conjunction with the optical viewer. This joystick switch is used to generate control signals relative to the movement of the stick while observing his progress on the viewer. The control signals are fed to the computer controller which drives the stepping motors of the x-y table. In this manner the operator moves the x-y table through the pattern by means of the manual control stick. The location of each stitch is inserted into the computer memory and finally recorded on magnetic tape.

DESCRIPTION OF THE DRAWING

This invention is more fully described in conjunction with the appended drawing which shows preferred embodiments of the invention and in said drawing.

THE PREFERRED EMBODIMENT OF THE INVENTION

Figure 1:
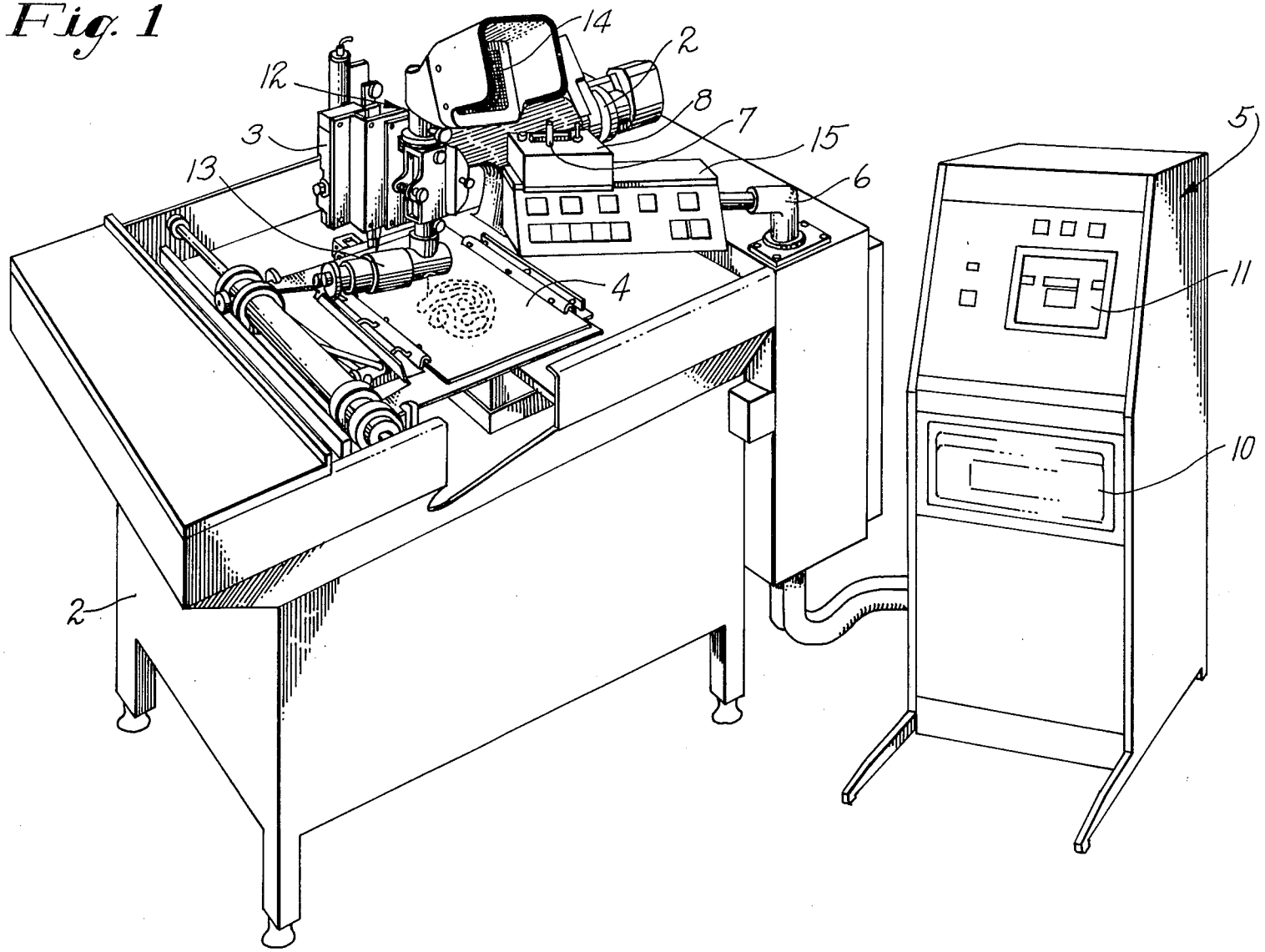
FIG. 1 is a perspective view of the system incorporating the invention.

The basic system to which this invention is adapted consists of an automatically controlled sewing machine as shown in FIG. 1. Such machines are commercially available for example the Model ACSA automatic controlled stitcher made by USM Corp., Beverly, Massachusetts. In this system a sewing machine 1 is mounted on a support 2 with its stitching head 3 extending over an x-y table 4. The x-y table 4 is mounted on the support 2 for movement along 2 coordinate axes relative to the stitching head 3. The x-y table is driven by digitally controlled stepping motors (not shown) located on each axis of the x-y table 4. A work piece is placed on the x-y table and moved through a predetermined pattern during the operation of the stitching head.

All machine functions are directed by a computer controller 5 which consists of a standard computer 10 such as the model PDP-8 manufactured by Digital Equipment Corporation of Maynard, Massachusetts and a tape reader 11 such as the Model TT100 tape transport with the read/write option, manufactured by Sykes Datatronics, Inc. The computer 10 is adapted to receive the coded signals from the tape reader 11.

Figure 2:
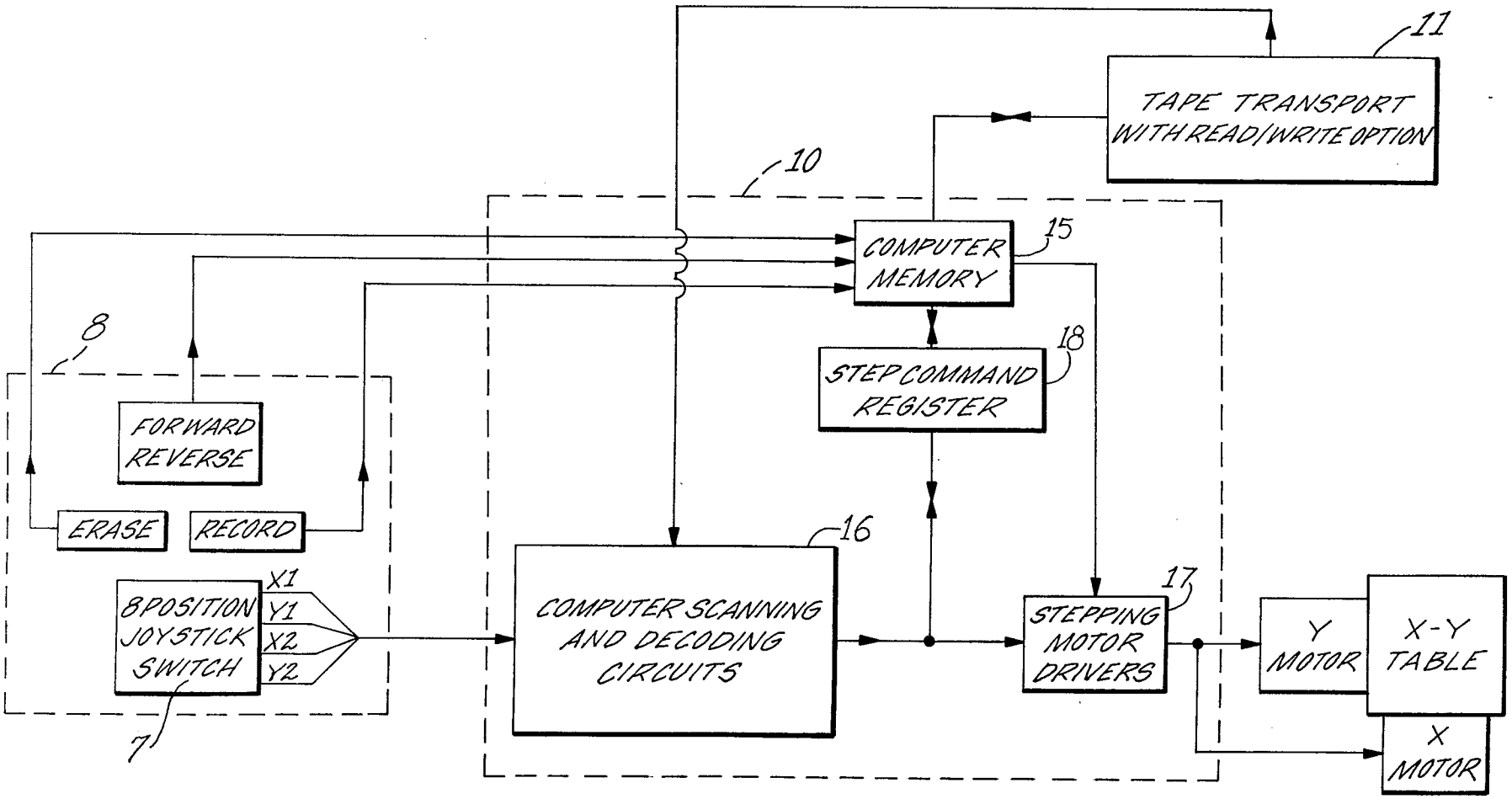
FIG. 2 is a block diagram of the system.

The basic parts of the computer system 10 are shown in the block diagram of FIG. 2. Under normal operating conditions of the automatic sewing machine shown, digitized pattern information is read in the tape transport 11 and transmitted to the computer scanning and decoding circuits 16 where it is transformed into coded signals which are transmitted to the motor drivers 17. The motor drivers 17 will then generate pulses which will cause movement of the x-y table through the predetermined pattern. Status information which may indicate modes of operation, stitch configuration, start and stop, are fed into computer memory 15 for storage. Each step of the pattern is counted in step command register 18 which will trigger the memory to generate status commands based on the stored status information. The functioning of a computer in this manner is well known in the prior art relating to the automatic control of x-y tables. This type of system used in conjunction with a sewing machine is commercially available as indicated above.

Control tapes are prepared by digitizing the stitch points of a specific pattern and recording them in coded form onto a magnetic tape. The computer 10 then receives the coded signals from the tape reader 11 and converts them to drive signals for the stepping motors of the x-y table 4. Other functions such as calibrations, speed, thread cutting and thread tension may also be coded into the tape. The tape preparation is currently performed on a separate computer system remote from the automatic sewing machine.

In order to adapt the automatic sewing machine for on machine pattern tape preparation, a second pattern signal input is connected to computer controller 5 through cable 6. The input is generated by a simple eight position joystick switch 7 which acts as a manual controller for the x-y table 4.

Figure 4:
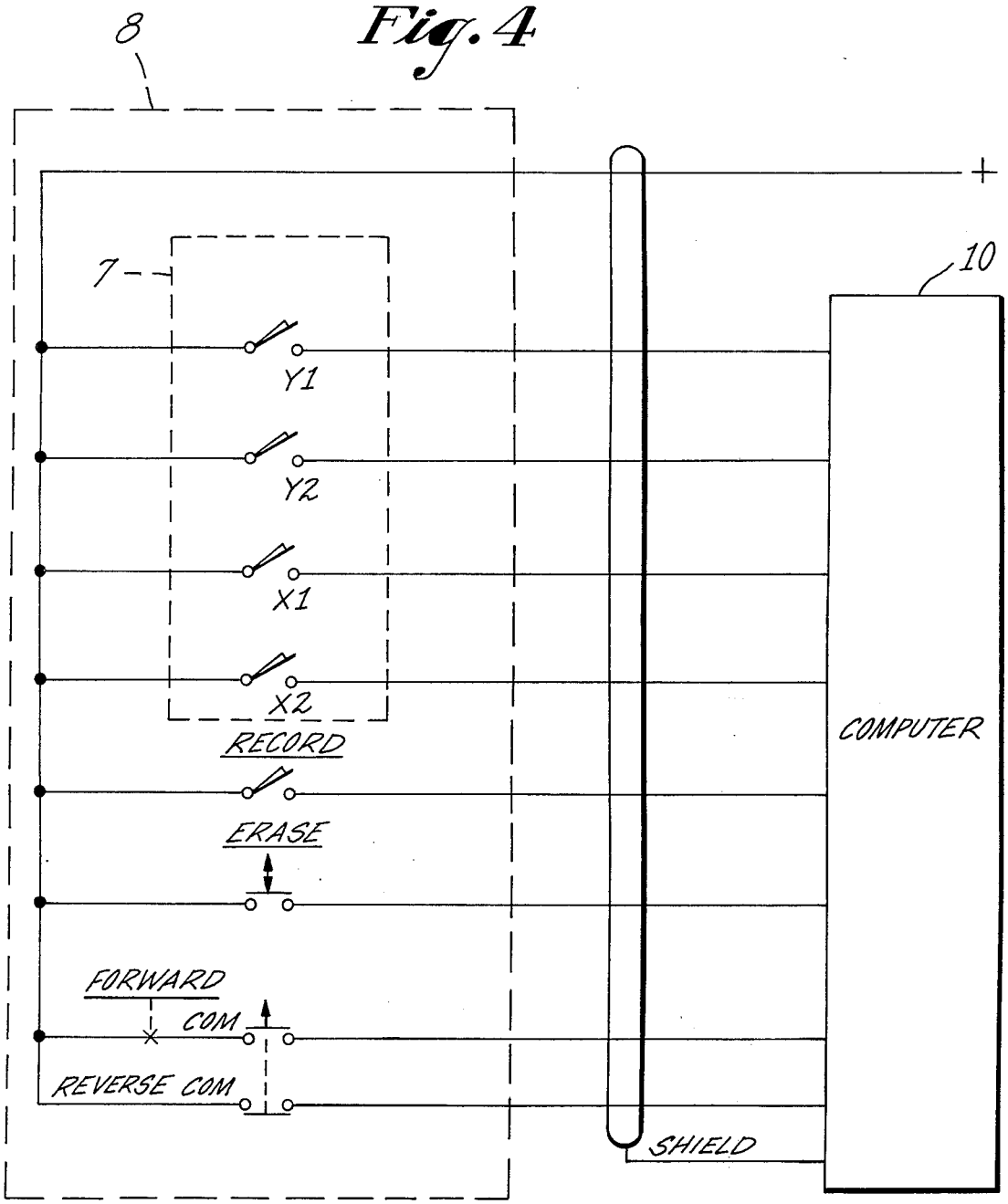
FIG. 4 is a circuit diagram for the manual control.
Figure 3:
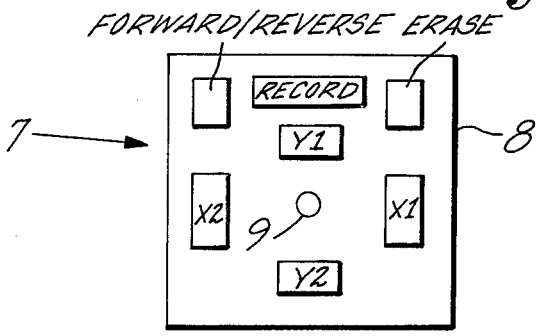
FIG. 3 is a schematic drawing of the manual control.

As shown in FIG. 3 the joystick switch 7 is mounted in a box 8 with a control stick 9 extending upward. Four of the eight stick positions are placed at 90 degree intervals corresponding to the x and y axes of the table 4. The remaining four positions are placed at 45 degrees in each quadrant of the x-y coordinate system. The circuit diagram for the joystick switch 7 is shown in FIG. 4. Each 90° throw of the control stick 9 actuates a single axis switch either $x_1$, $x_2$, $y_1$, or $y_2$, while the mid-quadrant throw will actuate both axis switches in that quadrant.

An optical viewing system 12 is mounted on the sewing machine 1 and consists of a projector assembly 13 and viewing screen 14. This type of apparatus may be similar to the model 3MB, MICROJECTOR, manufactured by Stocker and Yale, Inc., of Beverly, Massachusetts. The system 12 illuminates a portion of the x-y table 4 to allow the operator to view each stitch of a desired pattern, a model of which is placed on the table 4 and registered with respect to the needle position of the stitching head 3. The operator may, by the use of joystick switch 7 in conjunction with the viewing system 12, move the x-y table through the desired pattern while recording the coordinates of each stitch. Since the projector 13 is offset from the stitching head 3, the starting points of the model pattern and the actual stitched pattern identical. This requires compensation which may be accomplished either physically on the x-y table 4 or mathematically in computer 10.

The manual control box 8 contains the joystick switch 7 and any other switch used during the pattern tape preparation and is mounted on the control panel 15 of the automatic sewing machine.

In operation, the operator places a model pattern on the x-y table 4 in registered position with the needle location of the stitching head 3. After calibrating and focusing the projector 13 so that the crosshairs of the viewing screen 14 are coincident with the pattern starting point, the operator moves the x-y table 4 through the model pattern by actuating the joystick switch 7 as required. At each stitch point the coordinates are recorded in the memory of computer 10 and when the pattern is completed, this information is recorded in coded form on magnetic tape in the tape reader 11.

In order to aid the operator in locating each stitch point in the model pattern the computer retards the initial frequency of the drive signal to the stepping motors. In this manner the motors are slowly ramped to speed to allow the operator to have time to make only short advances if desired. The joystick switch 7 is designed to keep the axes switches actuated as long as the control stick 9 is in operating position and will return to the off position when released. This gives the operator an extremely simple and flexible manual control for the x-y table.

By adding a teletype terminal to the overall system, additional coded information can be added to the control tape namely status points, for initiating changes in speed, thread cutting, and thread change or inserting standardized pattern data. Additional modes of operation such as reverse, erase, and playback may also be provided.

Although this invention has been described in conjunction with an automatic sewing machine, it may prove useful with any type of apparatus which utilizes a computer controlled x-y table and requires a digitally coded input.

We claim:

1. A sewing machine for digitizing a predetermined pattern and thereafter stitching the predetermined pattern on a workpiece, said sewing machine comprising:

A. an x-y table for supporting a model of the predetermined pattern during a digitizing operation and for supporting a workpiece during the stitching operation;

B. an optical viewing system mounted above said x-y table for projecting the model pattern on a viewing screen so as to enable an operator to view the model pattern;

C. a manually-operated control means for generating signals relative to the desired movement of the x-y table during the digitizing of the model pattern;

D. a computer adapted to receive the manual control signals and convert the manual control signals to drive signals;

E. motor drive means adapted to receive the computer drive signals so as to perform the desired movement of the x-y table as dictated by the manually-operated control means; and F. recording means adapted to receive digitized information from the computer pertaining to the movement of the x-y table during the digitizing of the model pattern, said recording means being furthermore responsive to said computer for transmitting the digital information back to the computer during a stitching operation, said computer furthermore being operative to generate control signals to said motor drive means so as to subsequently cause the x-y table to be driven by said motor drive means during a stitching operation.

2. The sewing machine of claim 1 wherein the model of the predetermined pattern comprises a plurality of operating points which are to be successively registered with respect to said optical viewing system by manipulation of said manually-operated control means; and wherein said computer comprises:

A. register means, responsive to the drive signals to the motor drive means, for tracking the movement of the x-y table between successively registered operating points; and B. memory means for storing the digital information from said register means relating to the tracked movement of the x-y table between successive operating points in the model pattern.

* * * * *